US005242362A

United States Patent [19]

Talamantez

[11] Patent Number: 5,242,362

[45] Date of Patent: Sep. 7, 1993

[54] INSTALLATION APPARATUS

[76] Inventor: Homer J. Talamantez, 344 E. 21st St., Idaho Falls, Id. 83404

[21] Appl. No.: 660,907

[22] Filed: Feb. 27, 1991

Related U.S. Application Data

[63] Continuation of Ser. No. 437,190, Nov. 16, 1989, abandoned.

[51] Int. Cl.[5] ..... B25G 1/00; B25G 1/04; B25G 1/10

[52] U.S. Cl. ..... 492/13; 16/110 R; 16/115

[58] Field of Search ..... 15/230.11, 143 R, 143 A, 15/143 B, 144 R, 144 B, 209 D, 229.6, 244.2, 245, 144 A, 22.1, DIG. 10; 29/110.5; 51/392; 16/110 R, 111 R, 114 R, 115, 124, DIG. 24, DIG. 25, DIG. 41; 74/543, 544, 548; 81/177.1, 177.2, 489, 491

[56] References Cited

U.S. PATENT DOCUMENTS

| | | | |
|---|---|---|---|
| 184,918 | 11/1876 | Siddall | 15/143 R |
| 794,056 | 7/1905 | Stilwell | 15/230.11 |
| 1,436,155 | 11/1922 | Domy | 15/230.11 |
| 1,901,778 | 3/1933 | Schlag | 15/144 R |
| 2,123,813 | 7/1938 | Stiles | 16/111 R |
| 2,244,585 | 6/1941 | Twelt | 16/111 R |
| 2,536,607 | 1/1951 | Jenkins | 15/144 B |
| 2,547,451 | 4/1951 | Eber | 16/111 R |
| 2,982,981 | 5/1961 | Waara | 15/230.11 |
| 3,045,269 | 7/1962 | Coffman et al. | 15/144 R |
| 3,157,135 | 11/1964 | Febrow et al. | 29/110.5 |
| 3,263,260 | 8/1966 | Filler | 29/110.5 |
| 3,341,235 | 9/1967 | Mattson et al. | 16/115 X |
| 3,357,035 | 12/1967 | Ficke | 15/230.11 |
| 3,599,268 | 8/1971 | Simpkins | 15/230.11 |
| 4,197,764 | 4/1980 | Auerenhammer | 16/114 R X |
| 4,232,422 | 11/1980 | Fellmann | 16/110 R |
| 4,524,484 | 6/1985 | Graham | 16/115 |
| 4,683,610 | 8/1987 | Richards et al. | 16/115 |
| 4,701,142 | 10/1987 | Merritt | 16/114 R X |
| 4,958,407 | 9/1990 | Johnson | 15/144 R X |
| 4,982,470 | 1/1991 | Szabo | 15/144 R X |
| 5,054,830 | 10/1991 | Nisenbaum | 16/111 R X |

FOREIGN PATENT DOCUMENTS

| | | | |
|---|---|---|---|
| 330918 | 12/1920 | Fed. Rep. of Germany | 15/230.11 |
| 208870 | 9/1963 | Sweden | 15/144 B |
| 191483 | 9/1937 | Switzerland | 29/110.5 |

OTHER PUBLICATIONS

Crain Catalog No. 118C.

*Primary Examiner*—William E. Terrell
*Assistant Examiner*—Bryan Reichenbach
*Attorney, Agent, or Firm*—K. S. Cornaby

[57] ABSTRACT

A light-weight roller for rolling covering to uniformly distribute adhesive between the floor covering and floor, and to remove bubbles from therebetween. The roller utilizes removable, adjustable diameter rollers and has an adjustable handle to provide a variable rolling force on the floor covering depending upon the weight applied by the installer. The device is capable of applying floor coverings in a toe-kick space and in removing bubbles from beneath the floor covering.

9 Claims, 2 Drawing Sheets

INSTALLATION APPARATUS

This is a continuation of application Ser. No. 07/437,190, filed Nov. 16, 1989 entitled "Adjustable Apparatus For Rolling, Scraping, Painting And The Like," and which is now abandoned.

BACKGROUND OF THE INVENTION

This invention relates to a lightweight floor covering installation device with interchangeable rollers and an adjustable handle. The installation device of the present invention is utilized to roll floor coverings which have been applied to the floor surface with adhesive. Typical floor coverings applied with the inventive device include vinyl, linoleum and carpets. The device may be adapted to other functions as well, such as a scraper, sander or paint roller.

The process of applying a glued floor covering to a floor surface consists of cutting the material to the approximate size and shape, laying the material on the floor and trimming to the exact dimensions, folding the material in half to expose the floor surface in half of the area to be covered, applying glue to either the floor or the lower surface of the covering, laying this first half down on the floor, then repeating the folding and gluing process for the other half of the covering. The floor covering is rolled with a roller to evenly spread the glue below the floor covering, and to remove any bubbles accidentally entrained in the glue beneath the floor covering.

A typical prior art floor covering roller weighs approximately 100 pounds and is provided with one or more rollers of eight inches or more in diameter. The weight and size of such rollers are fixed and cannot be varied. A number of problems are inherent in using the heavy, large diameter roller of the prior art. For example, when rolling carpets, vinyl or other materials the normal procedure involves rolling the floor covering from the center of the newly-applied covering outwardly toward the edge, or periphery. Large diameter rollers of the prior art are incapable of securing the periphery of the floor covering to the floor adjacent a wall, since their size prevents application closer to the wall than the radius of the roll. A toe-kick cavity under cabinets and the like, typically four inches above the floor with a three inch overhang, requires that the roller be less than about four inches in diameter. Small hand-held rollers are available in the trade, but the installer must use the devices on his knees and has very little if any leverage to roll floor coverings under in the toe-kick cavity, which precludes applying significant downward pressure on the floor covering.

Another inherent problem with the heavy rollers of the prior art is that they compress the floor covering in both directions of travel since they are too heavy to lift. It is generally believed that compressing the floor covering against the adhesive in one direction, generally from the center of the floor covering outwardly in all directions, is preferred, in order to uniformly distribute the adhesive beneath the covering. The back-and-forth action of such large rollers does not permit the removal of excess adhesive or bubbles, but merely moves them around the room. Consequently, bubbles and excess adhesive may remain in the center of the floor beneath the covering.

Vinyl floor coverings may be configured to extend upwardly on a wall, with a quarter-round concave wood molding piece installed in the corner at the intersection of the wall and floor, under the vinyl. In this case the vinyl terminates about two to three inches up the wall. It would be advantageous to provide a floor covering roller with a radius of curvature approximating the concave radius of the quarter-round placed in the corner to assist in the adhesion of the vinyl to the quarter-round.

Because of their size the large rollers are difficult to manipulate near walls, cabinets, etc., and can therefore damage plaster, wood, paint and wall board very easily.

Finally, the conventional method of glue application presents a problem not heretofore solved by prior art apparatus'. When vinyl or carpet is folded in half so that adhesive may be applied to the other half, and the process repeated with the remaining half, it is not uncommon for an excess, or overlap of glue to occur at the fold line. This overlap of more than one layer of glue creates a thicker glue layer at the fold line. When the fold line is rolled using a heavy roller the excess glue is forced into a backing layer of the floor covering (the hydrocord felt backing), such that it is visible through the vinyl.

SUMMARY OF THE INVENTION

It is the purpose of this invention to provide a light, adjustable floor covering roller that will eliminate or correct the problems experienced in using prior art devices. The apparatus of the present invention comprises an adjustable, long-shafted floor roller with an adjustable handle that can be moved up or down the shaft and a hand grip near the top of the shaft.

The adjustable handle is perpendicular to the shaft and the hand grip at the top is preferably arranged at an obtuse angle to the shaft. The lower end of the shaft is provided with a yoke that supports an axle and a plurality of interchangeable rollers. The diameter of each set of rollers can vary from 1-inch to 12-inches. The floor roller of the present invention is light in weight (as little as 10–12 pounds), is able to function in small radius corners and in a preferred embodiment, the shaft is provided with an arcuate portion at the roller end to permit access to floor coverings under a cabinet toe-kick cavity. The inventive floor roller can be easily lifted from the floor and carried to a starting point to allow selective one-way rolling from center to wall, while permitting an installer to apply greater pressures than are available with conventional heavy rollers.

The present invention is adaptable to different roller sizes depending upon the requirements of the particular job.

Figure 3:
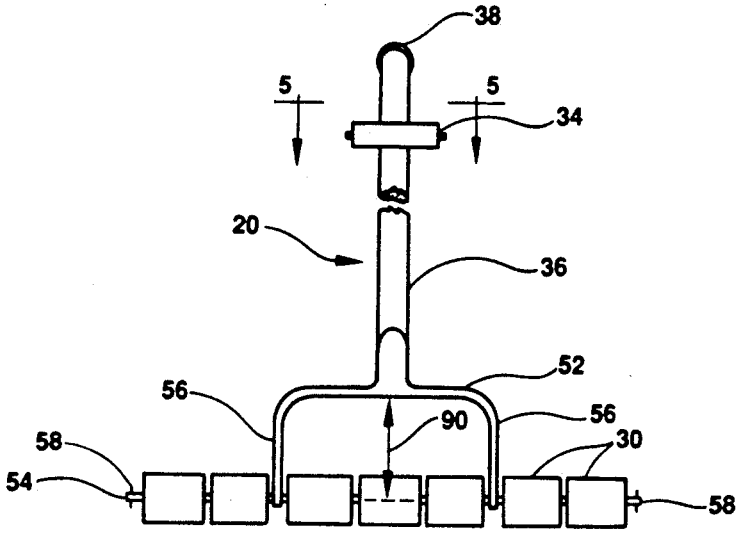
FIG. 3 is a front elevation of the apparatus of the present invention.
Figure 6:
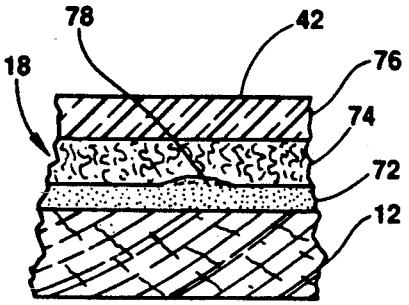
Figure 7:
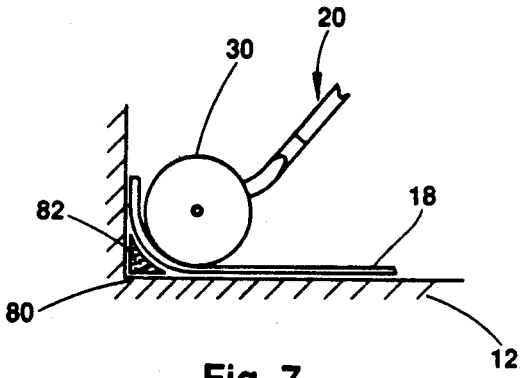
Figure 8:
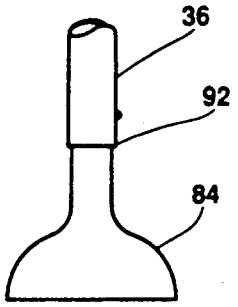
Figure 9:
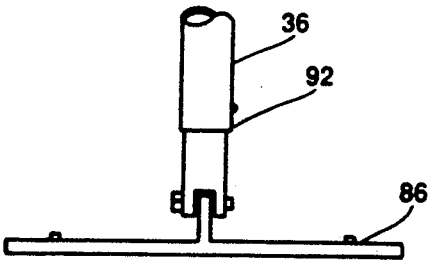
Figure 10:
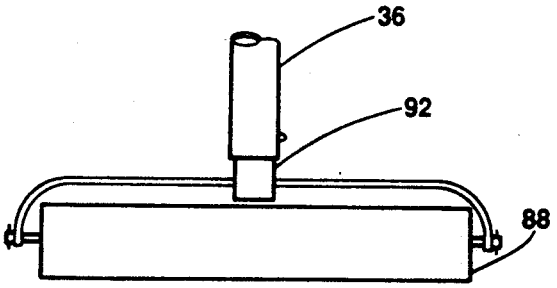

5 is a sectional view taken along lines 5—5 of FIG. 3;

FIG. 6 is a sectional view through a floor and vinyl floor covering;

FIG. 7 is a side view of the apparatus of the present invention in use in a second environment;

FIG. 8 is a partial elevation of a second embodiment of the present invention;

FIG. 9 is a partial elevation of a third embodiment of the present invention; and FIG. 10 is a partial elevation of a fourth embodiment of the present invention.

DETAILED DESCRIPTION OF THE INVENTION

Figure 1:
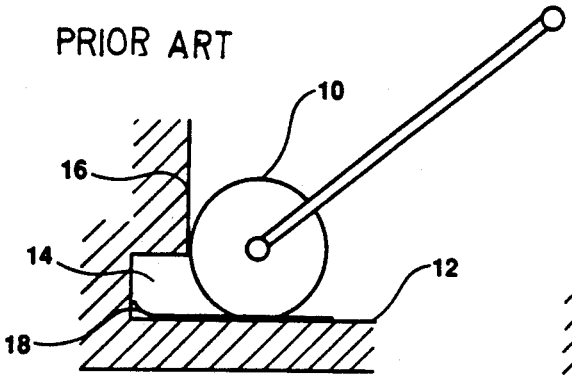
FIG. 1 is a side view of a prior art roller in use.

Referring to FIG. 1, a typical prior art large diameter roller 10 is illustrated in use at the edge of a floor surface 12 that terminates at a toe-kick cavity 14 beneath a cabinet 16. FIG. 1 illustrates one of the problems inherent in large diameter prior art rollers—they are unable to function in the approximate 4-inch toe-kick cavity. Therefore, in order to secure the floor covering 18 to the floor 12, a smaller, hand-held roller assembly must be utilized.

Figure 2:
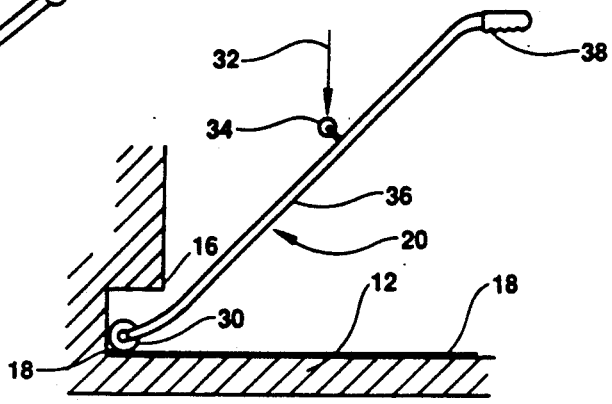
FIG. 2 is a side view of the apparatus of the present invention in use.

FIG. 2 illustrates the apparatus of the present invention. The floor cover roller 20 is illustrated in the same position as the prior art roller of FIG. 1. However, the smaller diameter roller 30 provides access beneath the cabinet 16 in the toe-kick cavity 14. FIG. 2 also illustrates how a significant force can be exerted on the rollers 30 by the installer bearing his weight downwardly in the direction of arrow 32 on the handle grip 34 with one hand while retaining the other end of shaft 36 at top grip 38 with a second hand.

As illustrated in FIG. 3, the floor cover roller 20 is provided with a yoke 52 fixedly secured to an axle 54 by a pair of legs 56. A plurality of interchangeable rollers 30 are rotatably secured to an axle 54 therethrough, and retained by, for instance, cotter pins 58. The yoke 52 connects directly to shaft 36.

Figure 4:
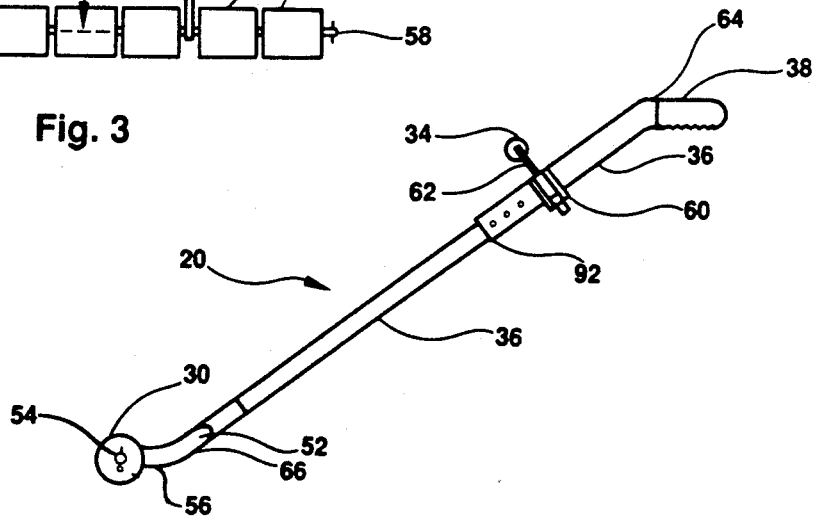
FIG. 4 is a side elevation of the apparatus of the present invention.

FIG. 4 illustrates the floor covering roller 20 having an adjustable handle grip 34. A strap 60 clamps the handle grip 34 and a handle grip yoke 62 at any position along the length of shaft 36. The position of handle grip 34 can therefore be adjusted to suit any floor covering installer, so that any required amount of downward force (up to the weight of the installer) can be applied to handle grip 34, and thereby to rollers 30. In the preferred embodiment of FIG. 4, the upper portion of shaft 36 immediately below the top grip 38 is bent to provide a fulcrum against which the full weight of the installer can be brought to bear. The lower portion of shaft 36 or the yoke 52 is provided with an arcuate section 66 to make entry into the toe-kick space 14 somewhat easier. The handle grip 34 is conventionally located near the center portion of the shaft 36.

Figure 5:
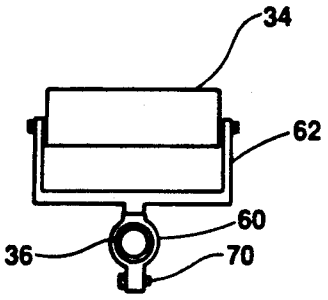

FIG. 5 is a section view through shaft 36 illustrating one embodiment for adjustably affixing handle grip 34 to the shaft 36. In this embodiment, strap 60 clamps the handle grip yoke 62 and handle grip 34 to the shaft 36 using a removable fastener 70, such as a bolt and nut.

FIG. 6 illustrates an enlarged section view through a typical vinyl floor covering 18 and floor 12. The view of FIG. 6 illustrates the fold-over situation set forth above, wherein an excess of adhesive 72 occurs at the location of the fold-over 42. Conventional vinyl floor covering material comprises a slightly porous hydrocord felt backing 74, to which is applied the vinyl patterned material 76. When great pressures are applied to this area, such as with the prior art roller of FIG. 1, the excess adhesive will migrate into the backing 74, and will be visible through the translucent vinyl material 76, as at 78. This problem can be avoided by using less pressure at the fold area 42, however this would require lifting the roller 10 off of the floor to avoid the fold area. Conversely, the apparatus of the present invention can apply any desired level of pressure to the floor covering since it is the body weight of the installer, applied at the handle grip 34, which compresses the floor covering into the adhesive, not the inherent and invariable weight of the roller.

FIG. 7 illustrates the use of the roller 20 of the present invention to apply floor covering 18 in a corner 80 having a concave quarter-round molding 82 to assure proper shape of the floor covering. The interchangeability of the rollers 30 of the apparatus permits the use of very small diameter rollers in this application so that the roller radius can be matched to the concave molding 82 radius.

While the figures illustrate the preferred embodiments, other embodiments will become apparent to those of ordinary skill in this art. For example, the number of rollers illustrated herein is almost infinitely variable depending upon the radius desired, width of the roller assemblage, etc. Additionally, the arcuate section 66 in yoke 52 (FIG. 4) may be removed if the device is to be used in rooms without toe-kick cavities.

While the apparatus has been disclosed herein for use with floor coverings, it is equally applicable to other applications, such as application of wall coverings, Formica® laminates, wall carpeting, or the fibrous-type wall papers.

The particular dimensions of the present invention are not critical, however the shaft 36 must be long enough to permit an installer to use it while standing up. Additionally, the shaft 36 may be adjustable to any desired length. The shaft may comprise removable sections, or it may telescope within itself as at 92 to provide varying lengths. The diameters of rollers 30 may be in the range of 1-12 inches and the corresponding yoke length dimension 90 (FIG. 3) must be at least 6 inches if interchangeability of rollers is desired. The interchange of rollers 30 is easily accomplished by removing retainers 56 (FIG. 3) from axle 54 and then removing the axle 54 from the yoke and the rollers 30.

While the apparatus is disclosed heretofore in the environment of floor covering installation, the apparatus is adaptable to a number of other uses. By removing the yoke 52, a scraper 84, (FIG. 8) can be removably affixed to the shaft 36 by any means well-known in the art. The scraper 82 is useful in removing adhered materials from a floor surface to which a floor covering is to be applied. Alternatively, as illustrated in FIG. 9, a rotatable sanding pad 86 can be removably affixed to the shaft 36 in order to sand, inter alia, gypsum sheet rock which has been taped and prepared for finishing. Lastly, with the yoke removed, a paint roller 88 can be removably affixed to shaft 36 (FIG. 10) for rolling paint on floors, ceilings, walls, etc.

The floor cover rollers and handles can be made from steel, aluminum, high strength plastic, rubber or any other high strength material, well-known to those skilled in the art.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

I claim:

1. Floor roller apparatus, comprising in combination: an elongate shaft having an upper end and a lower end;

a hand grip attached to the upper end of said elongate shaft at an obtuse angle with said shaft;

an elongate arcuate member having two ends and being attached at one end thereof to the lower end of said elongate shaft at an obtuse angle with said shaft, the arcuate member and the hand grip lying in a first plane parallel to and passing through said elongate shaft; wherein said arcuate member extends from said shaft in the opposite direction of said hand grip;

an axle yoke attached to the end of said arcuate member opposite the end attached to said elongate shaft;

an axle rotatably attached to said yoke;

a plurality of rollers rotatably attached about said axle each roller having a diameter of approximately 1–4 inches; a second plane perpendicular to said first plane and parallel to said elongate shaft, said second plane passing through said elongate shaft; and a pressure handle attached to said elongate shaft and lying in said first plane, said pressure handle and said hand grip being attached to said elongate shaft on opposite sides of said second plane.

2. A floor roller apparatus as set forth in claim 1, wherein said elongate shaft is adjustable in length.

3. A floor roller apparatus as set forth in claim 2, wherein said adjustable elongate shaft is adjustable by telescoping means.

4. A floor roller apparatus as set forth in claim 1, wherein said pressure handle is adjustably attached along the length of said elongate shaft.

5. A floor roller apparatus as set forth in claim 1, wherein the number of said rollers vary from 2 to 7 rollers.

6. A floor roller apparatus as set forth in claim 1, wherein said rollers are removable to vary the number and diameter of the rollers.

7. A floor roller apparatus as set forth in claim 1, wherein the floor roller apparatus weighs no more than approximately 12 lbs.

8. A floor roller apparatus as set forth in claim 1, wherein said shaft, elongate arcuate member, axle yoke, axle, and pressure handle of said apparatus are constructed of steel.

9. A floor roller apparatus as set forth in claim 1, wherein said shaft, elongate arcuate member, axle yoke, axle and pressure handle of said apparatus are constructed of aluminum.

* * * * *